US006173551B1

(12) United States Patent
Bowman, Jr. et al.

(10) Patent No.: US 6,173,551 B1
(45) Date of Patent: Jan. 16, 2001

(54) INK JET CODER SYSTEM AND METHOD

(75) Inventors: Richard E. Bowman, Jr., Quinton; Robert C. Kucera, Jr., Aylett; Patrick S. McElhinney, Richmond, all of VA (US); Sylvia L. Scaife, Charlotte, NC (US); Stephen D. Brown, Johnson City, TN (US)

(73) Assignee: Philip Morris Incorporated, New York, NY (US)

( * ) Notice: Under 35 U.S.C. 154(b), the term of this patent shall be extended for 0 days.

(21) Appl. No.: 09/056,342

(22) Filed: Apr. 7, 1998

(51) Int. Cl.[7] ..... B65B 61/26; B65B 57/02
(52) U.S. Cl. ..... 53/131.4; 53/64
(58) Field of Search ..... 53/411, 131.4, 53/131.5, 64, 389.4; 400/708; 101/424.1; 347/4, 104

(56) References Cited

U.S. PATENT DOCUMENTS 3,601,950 * 8/1971 Drent ..... 53/460
4,527,468 * 7/1985 Piotroski ..... 101/2
4,527,790 * 7/1985 Piotroski ..... 400/583.3
5,157,903 * 10/1992 Nakashima et al. ..... 53/504
5,205,104 * 4/1993 Nakashima et al. ..... 53/64
5,831,646 * 11/1998 Kuronuma et al. ..... 347/30
5,839,841 * 11/1998 Inui et al. ..... 400/708
5,841,450 * 11/1998 Kawamura ..... 347/32
5,844,813 * 12/1998 Tateyama ..... 347/5
5,880,747 * 3/1999 Bartenwerfer et al. ..... 347/4
5,949,444 * 9/1999 Geserich et al. ..... 347/4
6,030,132 * 2/2000 Harman et al. ..... 400/62

* cited by examiner

*Primary Examiner*—Brian L. Johnson
*Assistant Examiner*—Matthew Luby
(74) *Attorney, Agent, or Firm*—Burns, Doane, Swecker & Mathis, LLP

(57) ABSTRACT

A cigarette packing apparatus comprising means for repetitively progressing labels through a print location, a signal generator configured to generate a signal indicative of presence of the label as it passes adjacent the print location, a second signal generator configured to generate a signal indicative of a speed at the print location; a fluid jet printer head adjacent the print location and a controller configured to operate the printer head responsively to the first and second signal generators, with an additional arrangement within the packing apparatus defining a contact-free path portion sufficient for ink to dry at the indicia-bearing portion of the label as the label is progressed beyond the print location.

5 Claims, 9 Drawing Sheets

INK JET CODER SYSTEM AND METHOD

FIELD OF INVENTION

The present invention relates generally to ink jet printing of information on cigarette packaging, and more particular to apparatus and methods for applying pre-selected information on cigarette soft pack packaging utilizing ink jet technology.

BACKGROUND OF THE INVENTION

In cigarette production, bundles of cigarettes of a predetermined number (usually 20) are wrapped in a paper and aluminum laminate which is referred to in the art as "foil". Thereafter, the foil wrapped bundle ("foil-bundle") is enwrapped in either a soft pack label comprising a paper or paper laminate, or in the alternative is enwrapped within a cardboard hinge lid blank.

In the past, information concerning the product (such as its time and/or place of manufacture or other information at the election of the manufacturer) was embossed or otherwise applied to the foil portion of the packaging. A consequence of such arrangement was that the outer portion of the packaging, such as the soft pack label or the cardboard blank, together with any cellophane overwrap, would have to be removed in order to access the encoded information. Accordingly, prior practices necessitated the opening and or destruction of the cigarette pack in order to ascertain date of manufacture or the like.

Printing the desired encoded information upon the outer portion of the cigarette packaging has presented manifold difficulties. Cigarette manufacturing and packing operations are conducted at extreme speeds such that any on-line printing operation at the cigarette packer tends to cause ink smearing both upon the cigarette product and upon portions of the packing machinery. Ink smears on the product compromises its quality and may lead to additional rejection of product and other manufacturing inefficiencies. Ink smears on the manufacturing machinery necessitates clean-up, taking the machine out of production and so creating additional costs.

Another particular problem associated with soft pack cigarette product is that the body of the completed package is pliable and does not present a consistent surface for precise printing operations. Accordingly, the finished soft pack packaging itself is not conducive to printing operations once the package has been fully formed.

Another difficulty in attempting to execute on-line printing operations within a cigarette packing machine is that placement of printing apparatus may interfere with smooth and consistent feeding of the packaging material.

OBJECT AND SUMMARY OF THE INVENTION

Accordingly, it is an object of the present invention to provide a novel method and apparatus for applying printed indicia upon an outer portion of the cigarette packaging on an on-line basis at a cigarette packing machine.

Another object of the present invention is to provide a method and apparatus for repetitively and accurately placing printed indicia upon an outer portion of cigarette packaging at extreme machine speeds.

Still another object of the present invention is to provide a method and apparatus for applying printed indicia upon exterior portions of a cigarette packaging such that ink smears upon the packaging and/or upon packing machinery is avoided.

Still another object of the present invention is to execute an on-line printing operation without disturbing the smooth and consistent feeding of the packaging material, with particular concern of avoiding circumstances which would tend to skew packaging material from its intended pathway.

These and other objects are achieved by the present invention which provides a cigarette packing apparatus comprising means for repetitively progressing packaging material (preferably a soft pack label) through a print location, a signal generator configured to generate a signal indicative of presence of the packaging material as it passes adjacent said print location, a second signal generator configured to generate a signal indicative of a speed at the print location; a fluid jet printer head adjacent the print location and a controller configured to operate the printer head responsively to the first and second signal generators, with an additional arrangement within the packing apparatus defining a contact-free path portion sufficient for ink to dry at the indicia-bearing portion of the packaging as the packaging material is progressed beyond the print location. Another aspect of the present invention is provision for an air jet blower adjacent the print location to accelerate drying of the printed indicia.

BRIEF DESCRIPTION OF THE DRAWING

Other objects, advantages and novel features of the present invention will become apparent from the following detailed description of the preferred embodiments, when considered in conjunction with the accompanying drawing, wherein.

DETAILED DESCRIPTION OF THE PREFERRED EMBODIMENT

Figure 1:
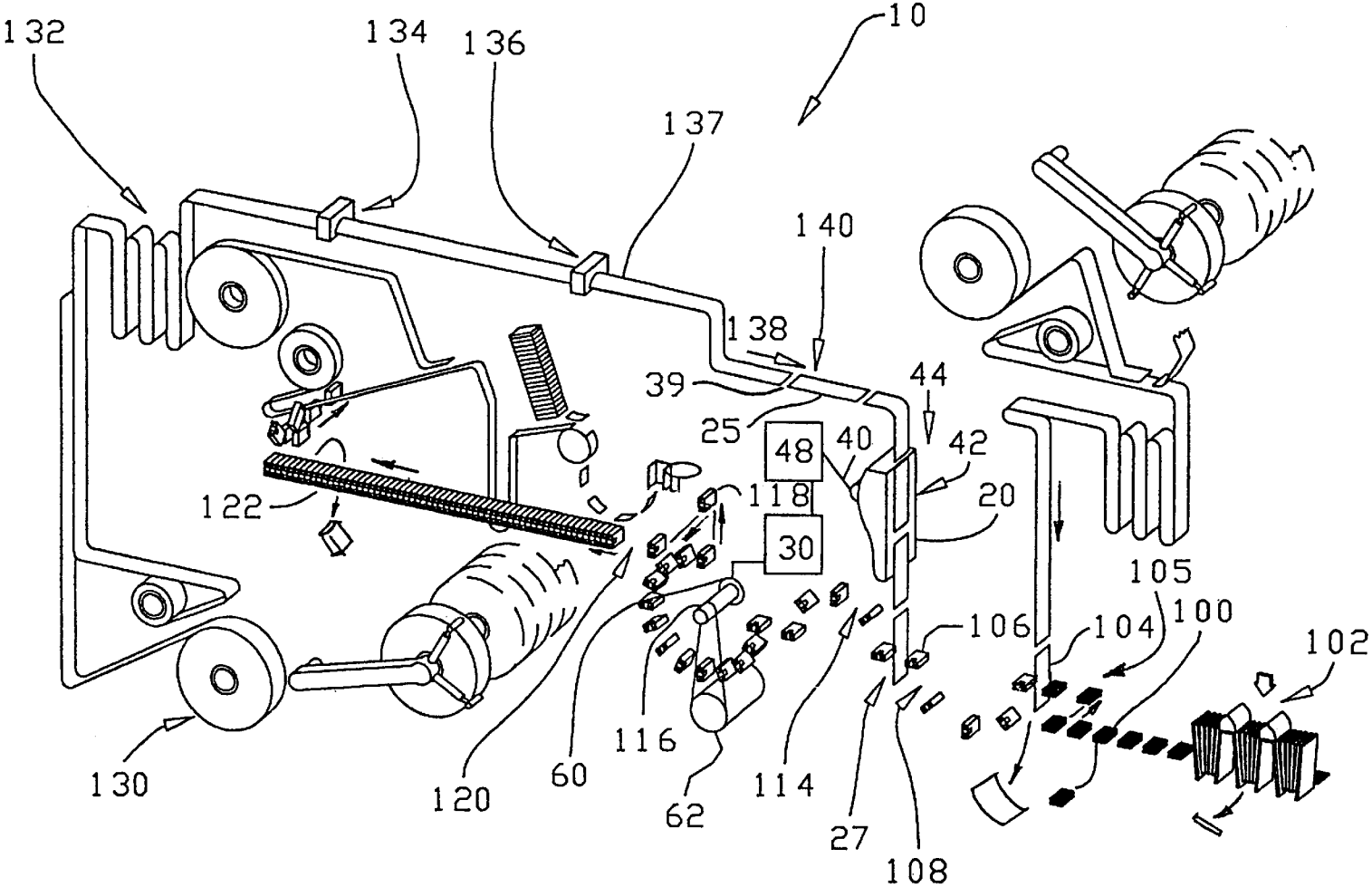
FIG. 1 is a schematic of a soft pack packing machine modified in accordance with a preferred embodiment of the present invention.
Figure 2A:
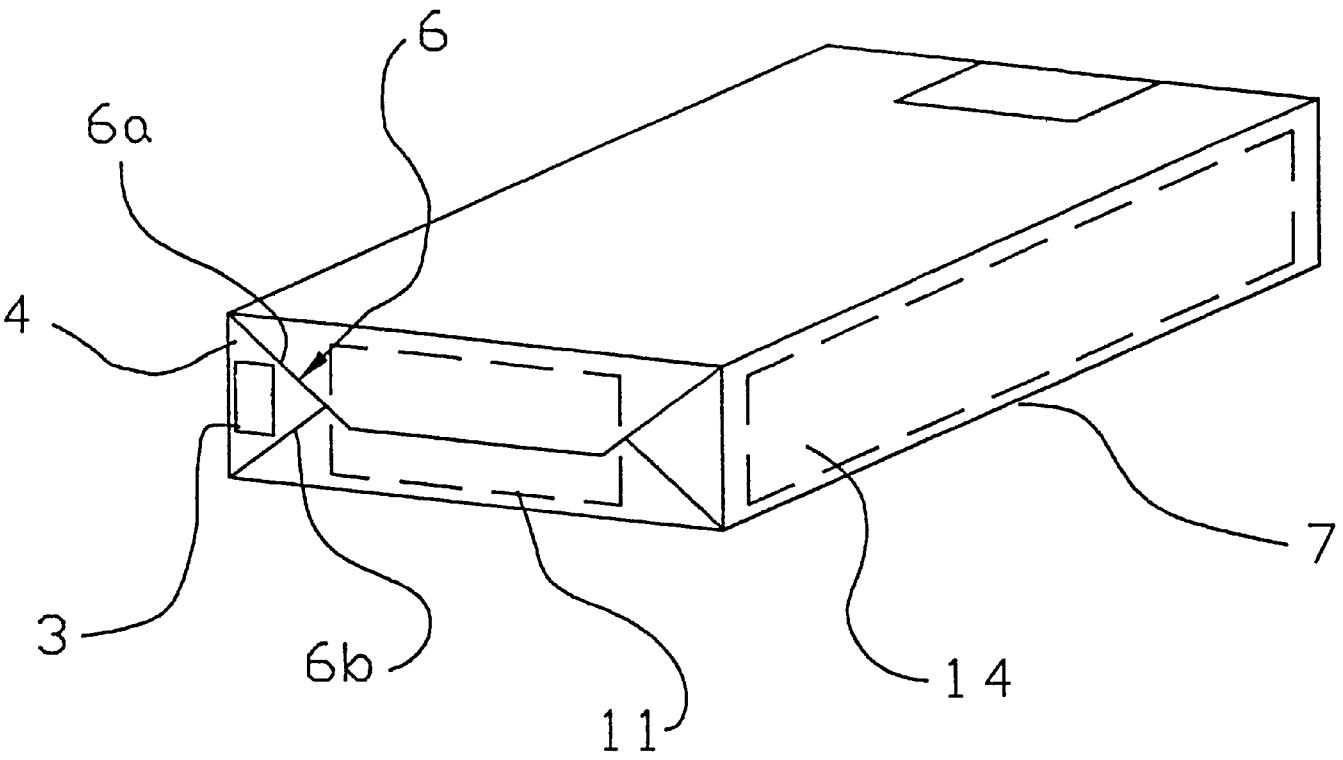
FIG. 2A is a perspective view of cigarette packaging which bears printed indicia applied in accordance with the present invention.
Figure 2B:
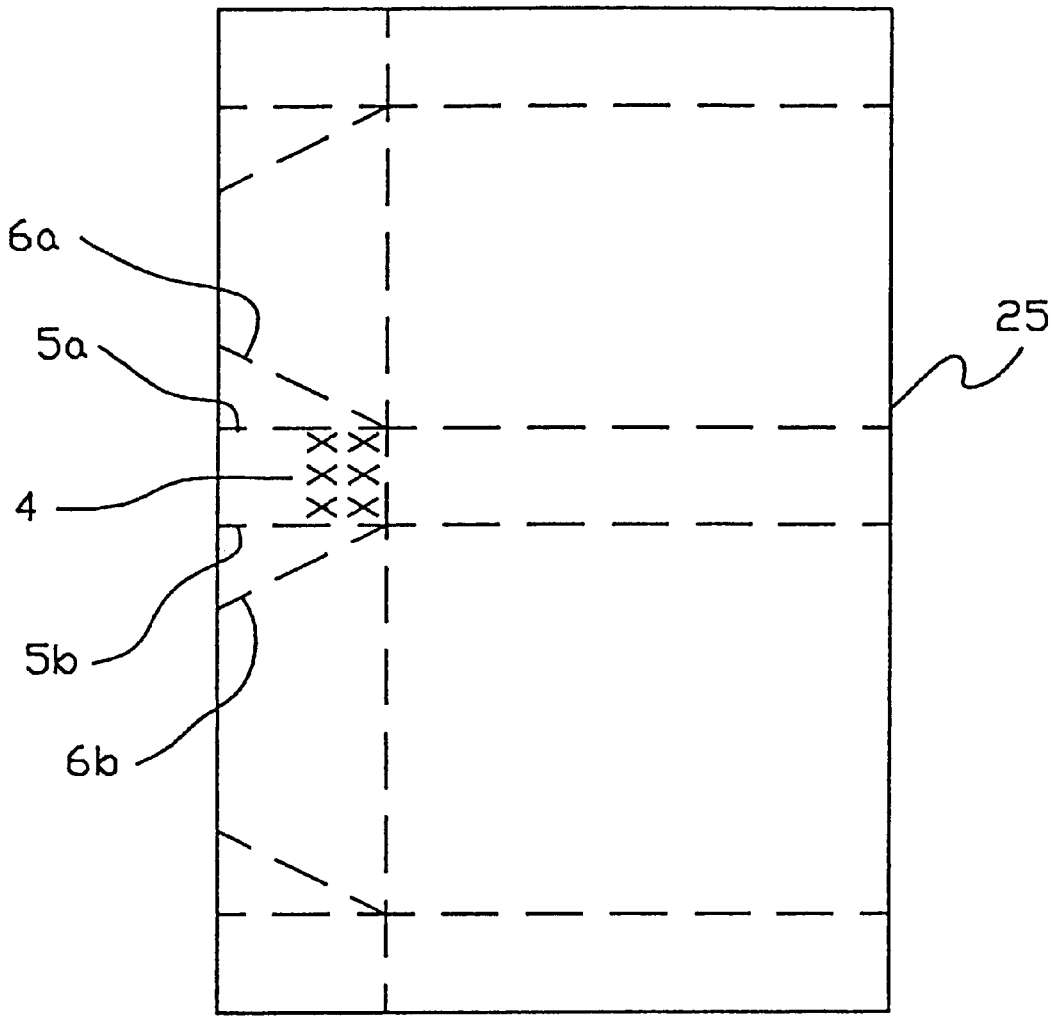
FIG. 2B is a planar view of the print-bearing side of an unfolded, cigarette packaging label bearing printed indicia applied in accordance with the present invention.

Referring to FIGS. 1 and 2B, the present invention provides a cigarette packaging apparatus 10 and method, wherein the apparatus 10 includes an ink jet printer system 40 in accordance with a preferred embodiment of the present invention. The packaging apparatus 10 typically includes a controller 30 having an operator interface for selectively controlling the speed and operation of the packaging apparatus 10. Preferably, the cigarette packaging apparatus 10 comprises a G. D X-1 or a G. D X-500 soft pack packing machine, which are manufactured and sold by G. D Societa per Azioni of Via Pomponia 10, 40100 Bologna, Italy, although the teachings which follow may be readily applied to other commercially available cigarette packaging machines upon a reading and understanding of the detailed description which follows.

The aforementioned packaging apparatus 10 includes a label-feed roller assembly 20 arranged to repetitively directing individual labels (soft pack labels) 25 along a vertical pathway 44 to a folding station 27. The timing and execution of the feeding operations through the label-feed roller assembly 20 and the timing and execution of folding operations at the folding station 27 are coordinated by the machine controller 30. In accordance with a preferred embodiment of the present invention, an ink jet printer system 40 is operative at a print location 42 along the label-feed roller assembly 20 so that the as the soft pack labels 25 progress along the feed path 44 and pass the print location 42, the ink jet printer system 40 applies pre-selected inked indicia 3 upon each of the soft pack labels 25 at a pre-selected location along each label 25.

Referring now to FIGS. 2A and 2B, the printed indicia 3 preferably comprise characters that encode or otherwise indicate information such as the date and/or place of manufacture, work shift or machine, brand type or other pre-selected bits of information. Preferably, the printed information is applied at a pre-selected panel portion 4 of the label 25, which upon conclusion of all folding operations, lies in a region between the fold lines 5*a* and 5*b* adjacent the vee fold lines 6*a* and 6*b* at the bottom in portion of the completed cigarette pack 7. Such location at the end fold portion is preferred, because it is usually is unobtrusive of decorative patterns or other printed matter such as tax stampings 11 or warnings 14 that are typically applied to the cigarette pack 7. Preferably, the pre-selected location 4 is surface treated, such as being scored or coated, so that they readily retain the ink received from the ink jet printer system 40.

The pre-selected locations 4 may be situated in places other than that specifically shown in FIGS. 2A and 2B, such as upon entirely different portion of the end panel or upon other panels of the label 25.

Figure 3:
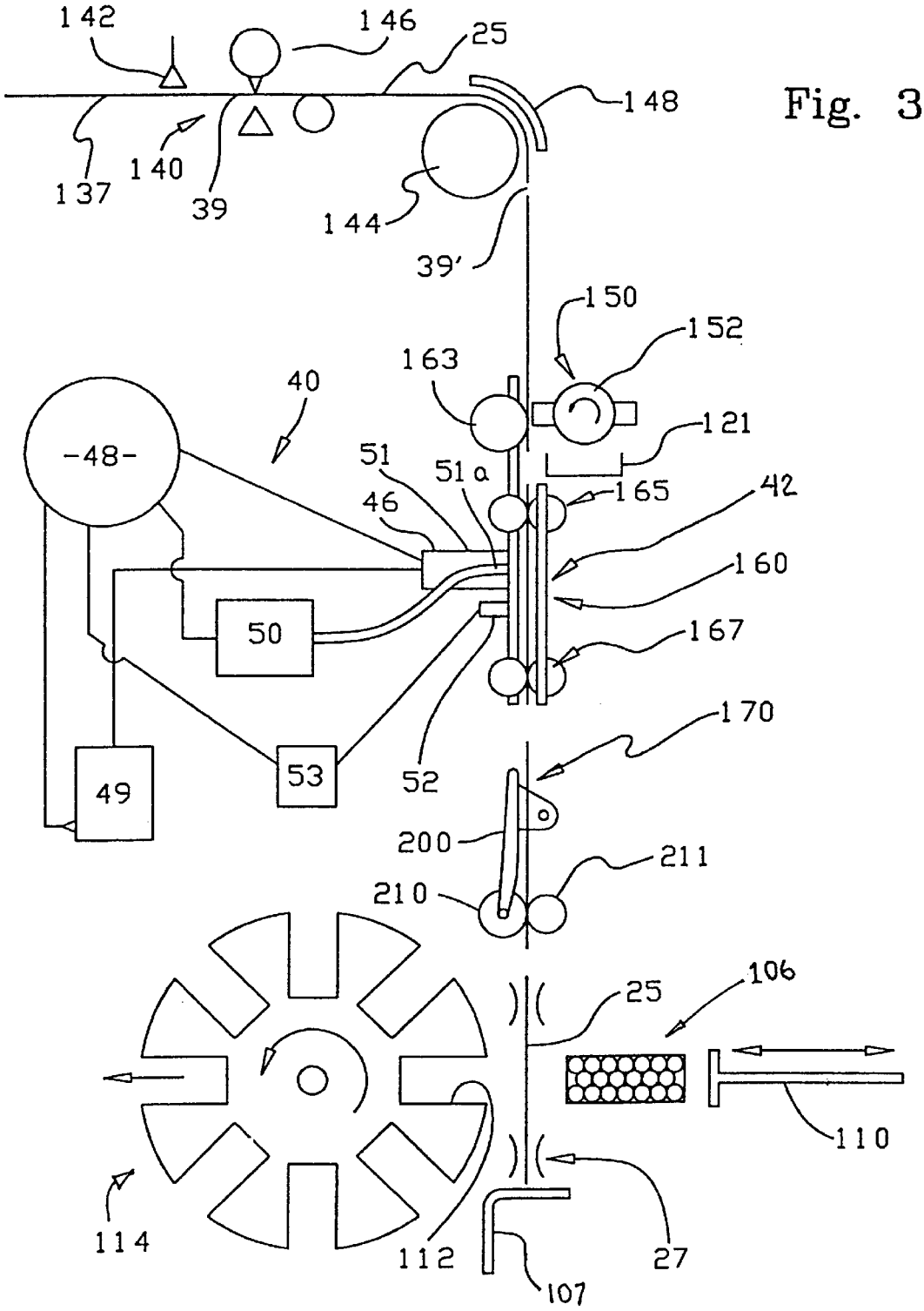
FIG. 3 is a schematic side view of a preferred embodiment of the present invention for the coding of soft pack cigarette packaging.

Referring now to FIGS. 1 and 3, the ink jet printer system 40 preferably comprises a print controller 48, an ink jet printer head 46 located adjacent the aforementioned print location 42, a product detect sensor 50 located adjacent (preferably to one side or just above) the ink jet printer head 46 and an air jet blower 52. Downstream of the print location 46, the label-feed roller assembly 20 is provided with arrangements that will be detailed in the discussion which follows, such that any printed indicia 3 that is applied to any label 25 by the ink jet printer head 46 is relieved of any contact with the label-feed system 20 such the labels 25 arrive at the folding station 27 in an unsmeared condition and without skew.

The controller 48 of the ink jet printer system 40 is linked to the controller 30 of the packaging apparatus 10 so as to receive signals from the latter indicating operation of the packaging apparatus 10 (an "on/off" signal) as well as its speed of operation (a "machine speed" signal). The latter signal may be routed from the controller 30, itself or directly off a shaft-encoder 60 typically provided as part of the general drive mechanism 62 of the packaging apparatus 10.

The preferred operational environment of the present invention includes a cigarette packaging apparatus 10 such as a G.D X-500 packer whose general layout is schematically represented in FIG. 1. Typically, such machines collate individual cigarettes 102 into a plurality of cigarette bundles 100 (usually 20 cigarettes per bundle) and direct same in succession onto a first rotatable machine wheel 105. At an exit portion of the first wheel 105, a plunger pushes the bundle 100 into a second machine wheel 108 together with a piece of foil 104, and the bundle 100 and foil undergo further wrapping operations. At the exit portion of the second wheel 108, the bundle 100 is fully enwrapped within the foil piece 104 and is situated adjacent a folding station 27 at which the label-feed assembly 20 has placed a label 25.

Referring now also to FIG. 3, the folding station 27 includes a vertically adjustable stop 170 at the folding station 27 for placing a received label 25 in a desired position relative to the third wheel 114 and the plunger 110 of the second wheel 108. The plunger 110 then urges the resultant foil bundle 106 through the folding station 27 so as to plunge the foil bundle 106 together with the label 25 into a receiver 112 of a third wheel 114 of the packaging apparatus 10.

Upon passage about arcuate portions of the third wheel 114 and transfer to and motion about the fourth wheel 116, the label 25 is wrapped about and folded into final form about the foil bundle 106. Upon removal of the folded cigarette package 118 from the fourth wheel 116, the folded cigarette package 118 is optionally passed through a closure stamp application station 120 and collected in face to face relation along an exit ramp 122.

Each of the first, second, third and fourth wheels 105, 108, 114 and 116 are driven by the drive system 62 of the cigarette packaging 10 such as is typically provided in GD X-1 and GD X-500 packing machines.

Typically, soft pack labels are fed from one or more continuous reels 130 through a system of tension rollers 132 and one or more decurlers 134, 136. Referring particularly to FIG. 3, the continuous ribbon of labels 137 passes along a horizontal path portion 138, along which is located a cutting station 140. In the preferred embodiment, the cutting station 140 includes a detector 142 for establishing a signal to the machine controller 30 that the continuous ribbon of labels 137 is adjacent the cutting station 140. A driven sector wheel 144 includes a notch 146 for registering with a leading edge 39 of the ribbon 137 as it locates at the cutting station 140. Upon registration, the cutter 146 severs the label 125 from the remainder of the ribbon 137. Upon completion of the severing step at the rotary cutter 146, the sector wheel 144 in cooperation with the arcuate guide 148 directs the label 25 into the label-feed roller assembly 20.

In the alternative, pre-cut labels 25 may be fed directly to the label-feed roller assembly 20. Preferably, such would include a feed arrangement in cooperation with the sector wheel 144 as previously described, or an equivalent thereof so as to properly direct individual labels 25 into vertical path portion 44 of the label-feed roller assembly 20.

In either event, preferably a glue applicator 150 is located just downstream of the sector wheel 144 to apply adhesive, preferably in the form of a liquid glue, to selected locations along the label 25 as it enters the label-feed roller assembly 20. Typically, the glue applicator 150 comprises one or more rotary daubers 152 placed adjacent glue pots 121 such that upon rotation the dauber picks up an incremental amount of adhesive from the glue pot 121 and places it upon a selected portion or portions of the label 25. Preferably, the dauber 152 applies adhesive to the non-printed side of the label 25.

Adjacent the glue dauber 152 is situated a door assembly 160 of the label-feed roller assembly 20. The door assembly 160 provides support for a back-up roller 163 arranged in opposing relation to the glue dauber 152. The door assembly 160 also supports a first set of opposing rollers 165 and a second, lower set of opposing rollers 167. The label-feed roller assembly 20 further comprises a delivery roller assembly 170 located beneath the door assembly 160. The delivery roller assembly 170 supports a guide plate 200, a roller pin 210 and a biased idler rollers 211 adjacent end portions of the roller pin 210.

Figure 4:
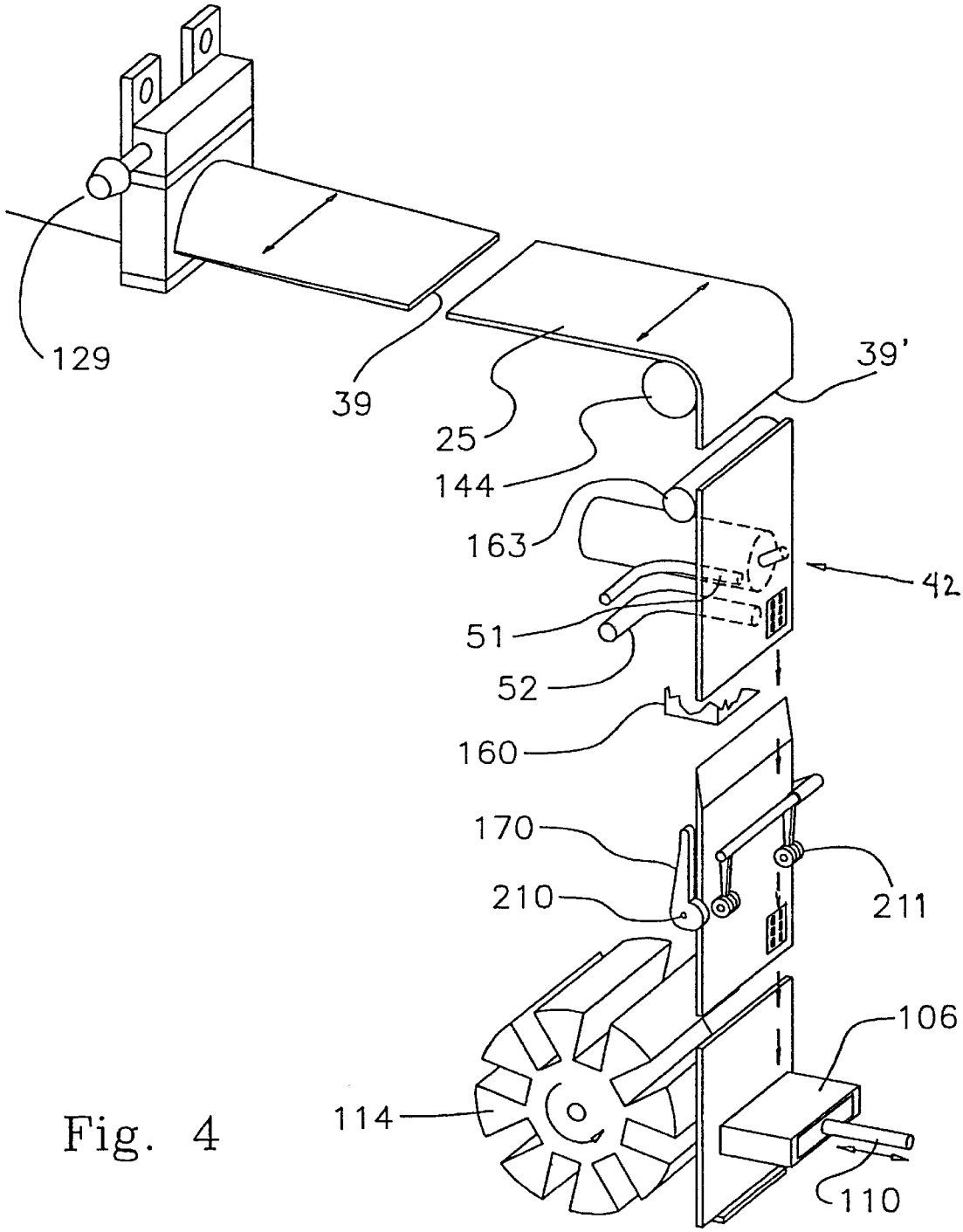
FIG. 4 is a perspective view of the preferred embodiment shown in FIG. 3.

Still referring to FIGS. 3 and 4, as a label 25 is drawn from the cutting station 140 by rotation of the sector wheel 144, it enters the door assembly 160 of the label-feed roller assembly 20, whereupon its leading edge 39' creates a change in light intensity that is detected by the sensor 50 through the light pipe 51 located adjacent the ink jet printer head 46. As a result, the print controller 48 commands execution of a print operation by the ink jet head 46 as the label 25 passes through the print location 42 along the door assembly 160. The controller 48 also executes a coordinated command to discharge air through the air jet port 52 to accelerate drying of the indicia 3 printed upon the label 25 by the ink jet printer head 46. The controller 48 is programmed to await receipt of the next signal from the sensor 50 that a subsequent label 25 has entered the print station 53.

Ink is supplied to each ink jet printer head 46 from a reservoir 49, whose level is monitored by the print controller 48 of the ink jet printer system 20. Preferably, the ink supplied and discharged from the ink jet printer head 46 is a quick-drying, water-based ink, preferably Number 99-4520 Q which is available from Videojet Systems International, Inc. of Wood Dale, Ill. 60191-1073.

The ink jet printer system 20 further includes a product detect sensor system preferably comprising an optical sensor 50 and an optical pipe 51 extending from the sensor 50 to a location adjacent the print location 42 on the door assembly 160. The sensor 50 is arranged to generate a signal upon detection of a change in light intensity received from the optical pipe 51. This indicative signal is communicated to the print controller 48 of the ink jet printing system 20. The light receiving end 51*a* of the optical pipe in a fixed position, preferably adjacent the ink jet printing head 46, preferably to one side or immediately above same.

Both the sensor system and the controller 48 is obtainable from Videojet Systems International, Inc. of Wood Dale, Ill. 60191-1073. The controller 48 preferably comprises a Videojet ES 170i Ultra High Speed Printer from the same Videojet Systems International, Inc. of Wood Dale, Ill. A suitable commercially available product suitable for use as the sensor 50 is a Tri-tronics Photoeye SER-FI. A commercially available Fiber Optic-Cable BF-B-36T and lens (UAC-5) may be used for the optical pipe 51.

The print controller 48 and system controller 30 are configured to operate the ink jet printer system 20 as follows: once the packaging machine 10 is powered up and the printer control box 48 is ready to print, the packaging machine 10 is allowed to start normally. If the printer 20 at any time is unable to print due to such factors as loss of power, low ink supply or make-up levels or other internal fault, the system controller 30 shuts down the packaging machine 10. A warning light is illuminated prior to shut down to indicate the aforementioned conditions, so as to facilitate corrective action by the operator.

When the packaging machine 10 is operating, the print controller 48 receives a signal from the product detect sensor 50 and a second signal from the shaft encoder 60 of the central drive system of the packaging machine 10 (in the alternative, the print controller 48 might be linked to a separate shaft encoder or other device; shaft encoders themselves employ a proximity sensor or the like to generate a signal upon each rotation of the shaft to which it is operatively affixed). From processing these signals, the controller 48 of the ink jet coder system 20 can resolve when a cut label 25 will arrive at the print location 42 and how fast it is moving. With such information, the controller 48 executes a printing operation such that the desired information is placed upon the packaging piece 25 consistently, both as to its placement, character size and layout.

In the printer head 46, ink is dispensed droplet by droplet in accordance with known fluid jet technologies, wherein ink is sent under pressure to an emitter having a nozzle, while at the same time a piezoelectric device (resonator) transmits acoustic vibration to the jet, causing the jet of ink to break up into droplets of a consistent size, such as approximately 70 microns or thereabouts. Typically, one or more electrodes adjacent the jet at the break-off point apply a charge proportional to the voltage applied to the electrodes.

The charged droplets are then directed between deflection plates between which an electrical potential is maintained. The droplets are thus deflected from their initial trajectory proportionately to their electrical charge. Any uncharged droplets are captured in a trap and recycled in the ink reservoir.

The combination of the drop deflection and of the object movement perpendicular to this deflection enables writing of all kinds of patterns, notably characters, on any substrate regardless of its nature.

The controller 48 is further programmed to operate the air jet blower 52 in timed relation to the aforementioned signals from product detect sensor 50 and shaft encoder 60. Preferably the air jet blower receives pressurized air from a machine system source 53 such as that supplied at the solenoid of the closure stamp application station 120. At the command of the print controller 48, such arrangement provides air to the jet blower 52 at a pressure of approximately 20 psiag when the machine 10 is operating at a speed of approximately 400 packs a minute. Other sources of machine-sourced air might be readily employed, or alternatively, separately dedicated sources of air or other gas.

Figure 5A:
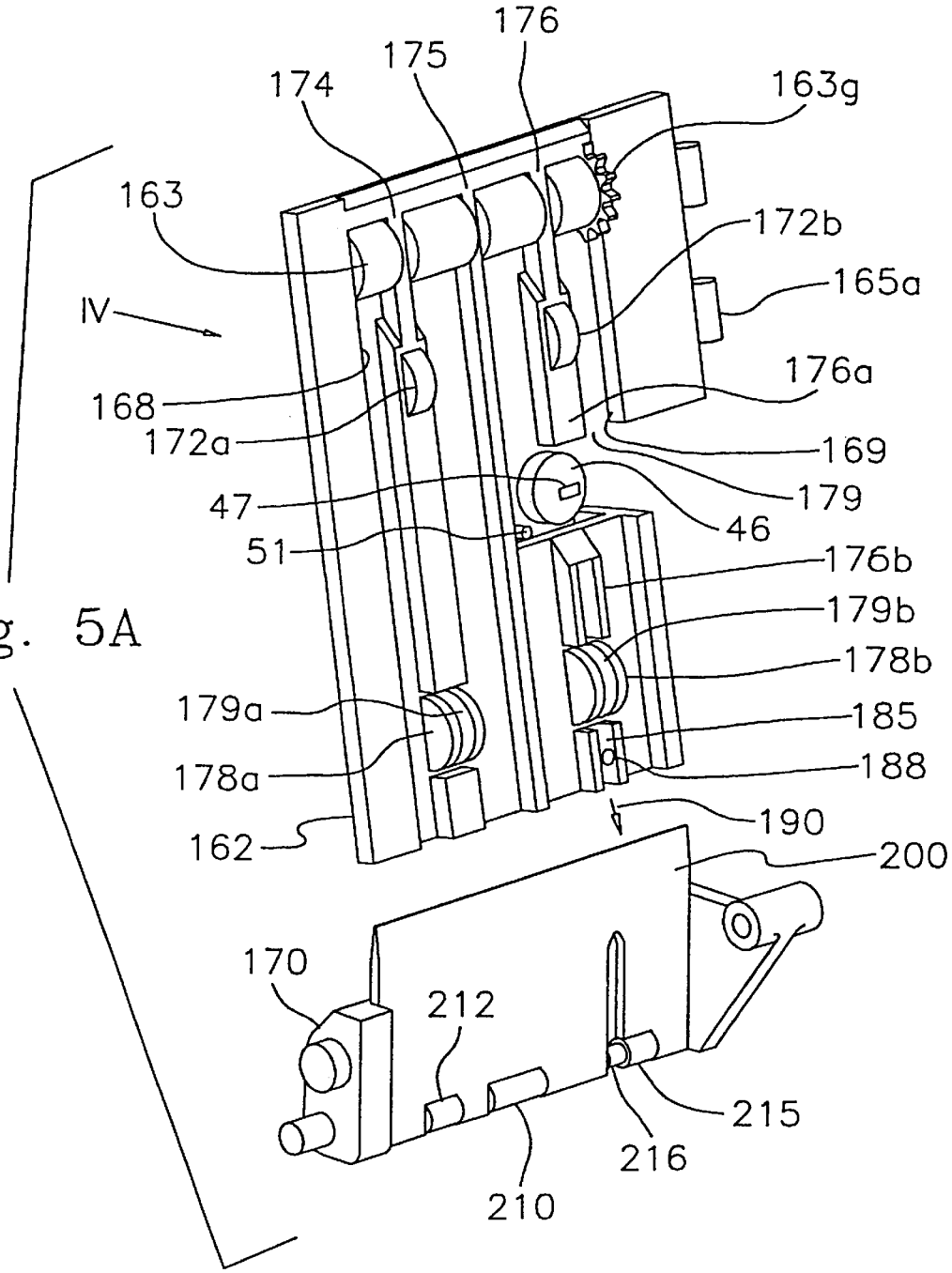
FIG. 5A is a detailed perspective view of portions of the fixed housing frame and the delivery roller assembly of the label-feed roller assembly constructed in accordance with the preferred embodiment shown in FIG. 3.
Figure 5B:
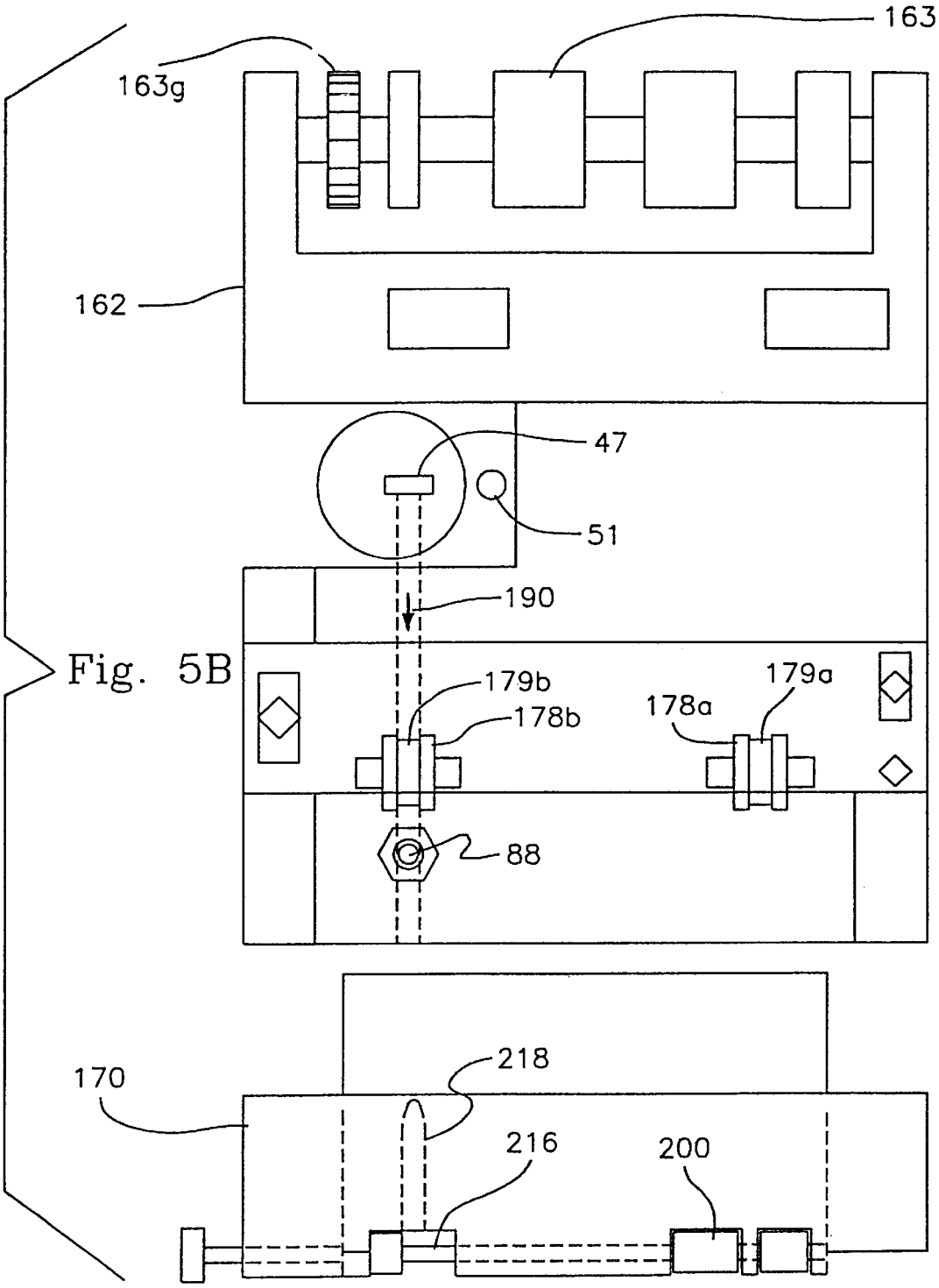
FIG. 5B is a planar view of a backside of the fixed housing frame shown in FIG. 5A.

Referring now to FIGS. 5*a* and 5*b*, the door assembly 160 preferably comprises a fixed housing frame 162 (FIG. 5*a*) and a pivotal housing frame 164 (FIG. 5B), which are hinged together at a hinge 165*a*, 165*b*, or some other convenient arrangement such that the pivotal frame may be swung away from the fixed door frame 162 after operations for accessing the interior of the door assembly 160 to clear jams or to perform maintenance and repair.

Referring particularly to FIG. 5A, the fixed housing frame 162 generally faces (is situated along) the print-bearing side of the labels 25 as they pass through the door assembly 160. The back-up roller 163 is supported at the upper portion of the fixed housing frame 162 and is driven by a gear-wheel connection 163*g* with the dauber 152. A first pair of idler rollers 172*b*, 172*b* are located beneath the back-up roller 163 and are part of the aforementioned opposing set of rollers 165. The fixed housing frame 162 also supports a second lower set of idler rollers 178*a*, 178*b* which are part of the aforementioned lower opposing set of rollers 167. The fixed housing frame 162 further includes guide surfaces, including longitudinal edges 168, 169, and at least two, preferably three, or possibly more, rails 174, 175 and 176 to confine the label 25 against excessive bending or folding action as it passes through the door assembly 160.

Preferably, the upper idler roller 172*a* and the lower idler roller 178*a* are located along the same rail 174, while the upper idler roller 172*b* and the lower idler roller 178*b* are located along the same rail 176. A transverse notch 179 is established in a middle portion of the fixed housing frame between the upper and lower sets of idler rollers 172*a,b* and 178*a,b* to provide a port through which the ink jet printer head 46 and the optical pipe 51 of the ink jet printing system 40 may locate. Preferably, the discharge port 47 of the ink jet printer head 46 is vertically aligned with the guide rail 176, and therefore the idler rollers 172*b* and 178*b* as well. Such alignment and proximity promotes consistent placement of the target surface portion 4 of each passing label 25 relative to the ink jet printer head 46.

The notch 179 in the fixed housing fame 162 bisects the rail 176 into an upper portion 176*a* having a smooth surface and a lower rail portion 176*b* the latter which is provided with a grooved surface 185. The groove 185 is vertically aligned beneath the discharge port 47 of the ink jet printer head 46 and is of a width sufficient to provide clearance for any printed indicia that may be applied to the passing label 25. In the preferred embodiment, the groove 185 is 15 millimeters wide and approximately one-half millimeter deep, although it is contemplated that the dimensions of the groove 185 might be varied in accordance with the particular application. For example, a wider field of printed indicia 3 might require a wider groove 185 and visa-versa.

Likewise, a groove 179*b* is provide in the lower idler roller 178*b* situated along the lower guide rail portion 176*b*. A similar groove 179*a* is provided in the other lower idler roller 178*a* so as to balance contact forces between the rollers 178*a*, 178*b* across the passing labels 25. Such arrangement minimizes skewing action as the labels 25 are fed through the door assembly 160.

The lower portion 176*b* of the guide rail 176 further includes at least one port 188 for the discharge of the air jet blower 52 upon printed indicia 3 as it passes along the vertical pathway 44 downstream of the ink jet printer head 46. Although the port 188 is shown at a location below the roller 178*b*, practice of the invention is entirely workable with placement of a port 188 above the roller 178*b*, whether in substitution or in addition to the port 188 shown in FIG. 5A. The air jet blower 52 is preferably mounted to the backside of the fixed housing frame 162.

Referring now to FIGS. 5A and 5B, as previously mentioned, the label-feed roller assembly 20 also includes a delivery roller assembly 170, which preferably comprises a fixed guide plate 200 configured to slidingly receive labels 25 after they are directed through the door assembly 160. The guide plate 200 includes a groove 218. The delivery roller assembly 170 further comprises a driven roller pin 210 that is rotatably disposed at a lower portion of the guideplate 200. A groove 218 is formed in the guide plate 200 in vertical alignment with the groove 185 of the lower rail portion 176*a* of the fixed housing 162.

Preferably, the roller pin 210 includes a first contact roller portion 212 which is preferably vertically disposed below the roller 178*a* of the door assembly 160. At its opposite end, the roller pin 210 includes a second contact roller portion 215 that is provided with a roller recessed portion 216. The roller recessed portion 216 is vertically aligned with the groove 218 of the guide plate 200, such that a contact-free pathway portion 190 is defined by the groove 185 in the lower rail portion 176*a* of the door assembly 160, the groove 179*b* of the idler roller 178*b*, the groove 218 of the guide plate 200 and the roller recessed portion 216 of the roller pin 210. Accordingly, there is established a continuation of the contact-free pathway 190 beginning at the proximity of the discharge port 47 of the ink jet gun 46 and extending through both the door assembly 160 (along the groove 185 of the rail portion 176*b* and the groove 179*b* of the idler wheel 178*b*) and the roller delivery assembly 170 (along the groove 218 of the guide plate 200 and the recessed portion of the roller pin 210) so that the printed indicia 3 on a passing label 25 arrives at the folding station 27 in an unsmeared condition.

Figure 5C:
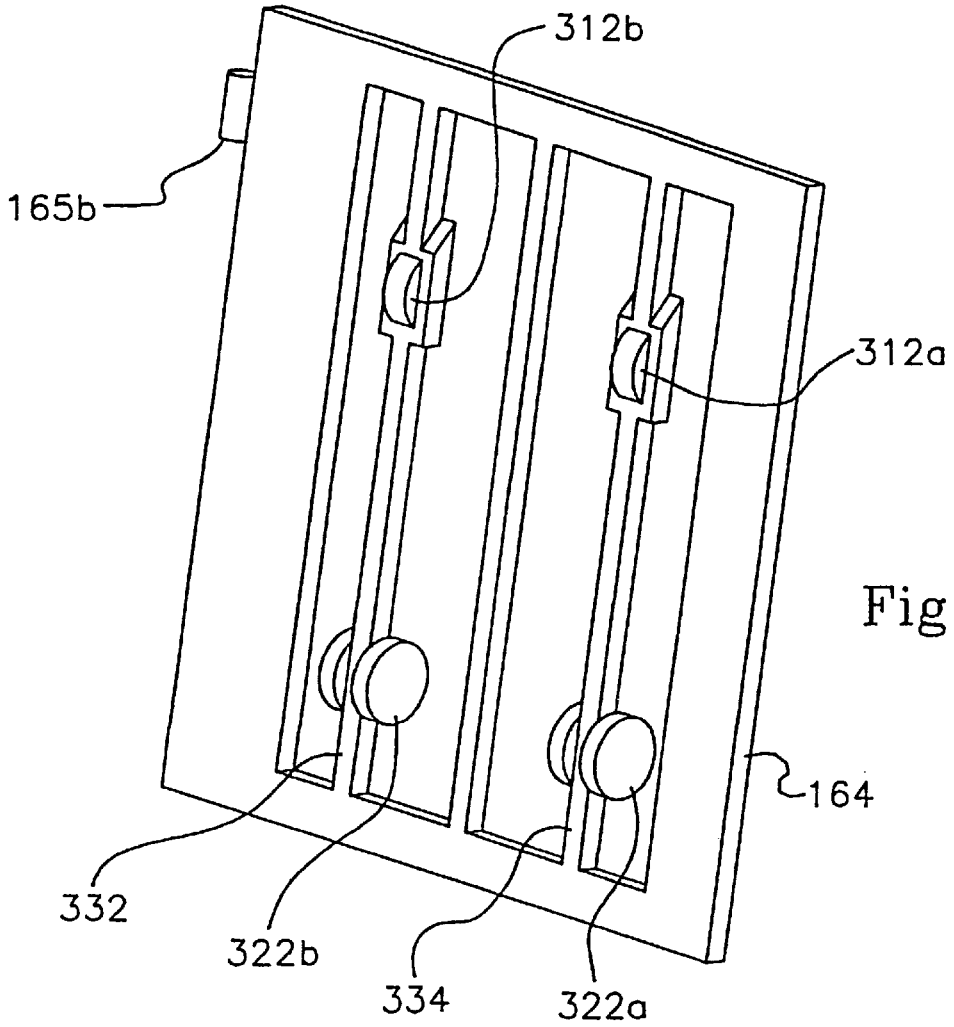
FIG. 5C is a detailed perspective view of a pivotal housing frame of the label-feed roller assembly constructed in accordance with the preferred embodiment shown in FIG. 3.
Figure 6:
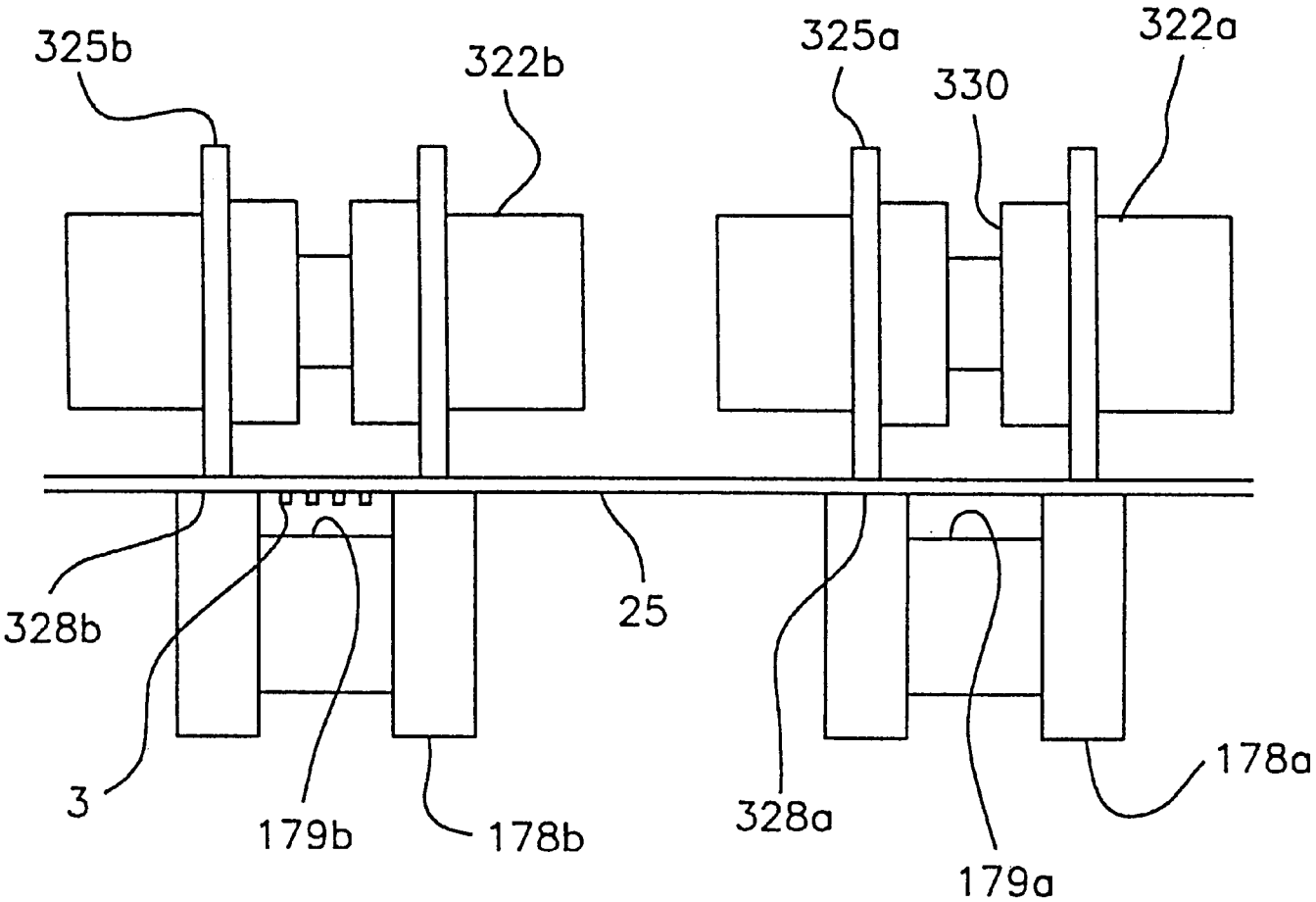
FIG. 6 is a top planar view of a packaging label passing between lower idlers rollers of the fixed housing frame and the lower driven rollers of the pivotal housing frame.

Referring now to FIG. 5C, the pivotal housing frame 162 includes driven rollers 312*a* and 312*b* which are disposed in opposing relation to the idler rollers 172*a* and 172*b* of the fixed housing frame, respectively, when the pivotal housing frame 164 is closed against the fixed housing frame 162. Likewise, the pivotal housing frame 164 includes a second lower pair of driven rollers 322*a* and 322*b* which are disposed in opposing relation to the idler rollers 178*a* and 178*b* of the fixed housing frame, respectively, when the pivotal housing frame 164 is closed against the fixed housing frame 162. Referring now also to FIG. 6, preferably, both driven rollers 322*a* and 322*b* include rims 325*a* and 325*b*, respectively, of a slightly lesser width than the widths of the opposing portions 328 of the idler rollers 178*a* and 178*b*. The driven rollers 322*a* and 322*b* include a second recess 330 where the rollers 322*a* and 322*b* receive rails 332 and 334 of the housing frame 164, respectively. Another middle rail 336 is preferably situated between the rails 332 and 334. Preferably, the rollers 312*a,b* and 322*a,b* of the pivotal housing frame 164 are driven off the central drive system of the packaging machine 10 as is typically provided in a G. D X-1 or G. D X-500 machine.

Referring to back to FIG. 4, the cigarette packaging apparatus 10 preferably includes an arrangement for adjusting the lateral placement of the ribbon of labels 129 and therefore the lateral placement of individual labels 25 relative to the ink jet printer head 46 so that accurate placement can be maintained and machine drift maybe compensated. In particular, the arrangement includes a manually adjustable slider mount 133 at least one, but preferably both of the de-curling assemblies 134 and 136. A GilmanPrecision Slide available from Russel T. Gilman, Inc. is a preferred, commercial available mount for this application. The arrangement facilitates placement of the printed indicia 3 exactly where desired during start up and to compensate for any drifting during extended machine operations and/or other causes of displacements of the indicia 3, such as from bobbin changes.

It is to be appreciated that the preferred embodiment of the present invention provides ink jet printing of soft pack labels and the like at a print location 42 sufficiently removed from the folding station 27 such that the printed indicia is given a time to dry before it enters folding operations. The allotted spacing, together with the special handling of the label through the label-feed roller assembly 20 (providing a contact-free portion and symmetry at the rollers to minimize skewing) provides a unique effective manner for applying information upon soft pack cigarette packages that is readily readable without the destruction of product.

Thus, it is provided an apparatus and method for manufacturing cigarette packaging featuring ink jet coding. One skilled in the art will appreciate that the present invention can be practiced by other than the preferred embodiments, which are presented for purposes of illustration and not limitation, and the present invention is limited only by the claims that follow.

What is claimed is:

1. A cigarette packaging apparatus comprising:

a folding station configured to at least partially wrap a label about a pre-arranged bundle of cigarettes;

means for repetitively dispensing labels along a pathway leading to said folding station;

a first signal generator arranged to generate a signal indicative of a speed of the label along said pathway;

a second signal generator adjacent a print location along the aforementioned pathway configured to generate a signal indicative of presence of the label as it passes adjacent said printing location;

a first controller which controls said dispensing of said labels and folding operations performed by said folding station;

a fluid jet printer head adjacent the print location and a second controller which is in communication with said first controller and which operates said printer head responsive to signals generated by said first and second signal generators so as to controllably apply printed indicia upon a pre-selected portion of said label as it passes said print location; and an arrangement providing a contact-free path portion along which said pre-selected indicia-bearing portion traverses as said label is progressed from said print location to the folding station so that said label arrives at said folding station in an unsmeared condition;

wherein said means for repetitively dispensing labels comprises a label-feed roller assembly, said label-feed roller assembly directing said packaging material along said path across said print location, said label-feed roller assembly defines said contact-free path portion downstream of said print location wherealong said applied indicia is maintained in a spaced relation from opposing portions of said label-feed roller assembly;

wherein said label-feed roller assembly includes a fixed housing portion, said fixed housing portion including a grooved guide rail along said contact-free path portion; and wherein said label-feed roller assembly includes a grooved roller at a location along said guide rail.

2. The cigarette packaging apparatus as claimed in claim 1 further comprising a gas blower adjacent said print location and configured to apply a discharge of gas upon said indicia bearing portion as said bundle is directed along said contact-free path portion.

3. The cigarette packing apparatus as claimed in claim 1, wherein said label-feed roller assembly includes a second grooved roller located transversely of said guide rail location along said guide rail.

4. The cigarette packing apparatus as claimed in claim 3, wherein said label-feed roller assembly includes a delivery roller assembly downstream of said fixed housing portion, said delivery roller assembly including a groove and a recessed roller pin portion aligned with said grooved guide of said fixed housing portion.

5. The cigarette packing apparatus as claimed in claim 3, further comprising a label decurler upstream of said label-feed roller assembly, said label decurler being laterally adjustable in position relative to said label-feed roller assembly.

* * * * *